US005429174A

United States Patent [19]

Wahnsiedler

[11] Patent Number: 5,429,174

[45] Date of Patent: Jul. 4, 1995

[54] VACUUM DIE CASTING MACHINE HAVING IMPROVED SIPHON TUBE AND ASSOCIATED METHOD

[75] Inventor: Walter E. Wahnsiedler, Oakmont, Pa.

[73] Assignee: Aluminum Company of America, Pittsburgh, Pa.

[21] Appl. No.: 231,137

[22] Filed: Apr. 22, 1994

Related U.S. Application Data

[63] Continuation of Ser. No. 93,261, Jul. 15, 1993, abandoned.

[51] Int. Cl.[6] ..... B22D 17/08; B22D 41/50

[52] U.S. Cl. ..... 164/113; 164/312; 164/61

[58] Field of Search ..... 164/61, 63, 65, 113, 164/337, 306, 312, 316, 254

[56] References Cited

U.S. PATENT DOCUMENTS

| | | | |
|---|---|---|---|
| 2,785,448 | 3/1957 | Hodler | 164/254 |
| 2,977,649 | 4/1961 | Morton | 164/312 |
| 3,065,510 | 11/1962 | Parker | 164/254 |
| 3,121,926 | 2/1964 | Morton | 164/257 |
| 3,137,903 | 6/1964 | Morton | 164/312 |
| 4,660,614 | 4/1987 | Spriestersbach et al. | 164/312 |
| 4,828,460 | 5/1989 | Saito et al. | 164/312 |
| 5,201,358 | 4/1993 | Stummer et al. | 164/312 |

FOREIGN PATENT DOCUMENTS

| | | | |
|---|---|---|---|
| 895181 | 1/1945 | France | 164/254 |

*Primary Examiner*—Kuang Y. Lin
*Attorney, Agent, or Firm*—David V. Radack; Thomas R. Trempus

[57] ABSTRACT

Vacuum die casting machine including an improved siphon tube for transporting molten metal from a reservoir to a shot cylinder. The siphon tube defines a passageway having a first end portion which is adapted to communicate with a shot cylinder and a second end portion opposite the first end portion which defines a molten metal entry portion. The passageway tapers from the first end portion to the second end portion which reduces jetting in the shot cylinder. An associated method is also disclosed.

11 Claims, 2 Drawing Sheets

VACUUM DIE CASTING MACHINE HAVING IMPROVED SIPHON TUBE AND ASSOCIATED METHOD

This is a continuation of application Ser. No. 08/093,261 filed Jul. 15, 1993, now abandoned.

BACKGROUND OF THE INVENTION

This invention relates to a vacuum die casting machine having an improved siphon tube and an associated method and more particularly to a siphon tube which is configured to reduce jetting in the shot cylinder of the vacuum die casting machine.

Vacuum die casting is a vacuum based method for producing metal parts by injection of liquid metal into a die using a piston and cylinder arrangement. Molten metal alloy, such as aluminum alloy, is drawn up by a siphon tube from a reservoir and into a shot cylinder by a vacuum. A piston is then used to rapidly inject the molten metal into a die.

A problem arises when metal build-up or necking in the siphon tube occurs as the liquid metal which is drawn from the metal reservoir freezes on the inside surface of the siphon tube. Excess build-up can lead to a phenomenon known as "jetting". Jetting occurs when the liquid metal, which is being forced through a small diameter, forms a jet of metal which impinges on the shot cylinder's top inside wall. This is a universally undesired result which leads to wear of the shot cylinder and the piston and repeated scraping of partially frozen material from the cylinder walls during each stroke.

Thus, there remains a need for an improved vacuum die casting machine which minimizes the effects of jetting in a simple and efficient manner.

SUMMARY OF THE INVENTION

The invention has met the above need. The vacuum die casting machine of the invention includes the improved siphon tube for transporting molten metal from a reservoir to a shot cylinder. The siphon tube defines a passageway having first end portion which is adapted to communicate with the shot cylinder and a second end portion opposite the first end portion which defines a molten metal entry portion. The passageway tapers from the first end to the second end which reduces jetting in the shot cylinder.

The invention also includes a method of making an aluminum casting comprising providing a supply of molten aluminum alloy and drawing the molten aluminum alloy through a siphon tube to a shot cylinder by vacuum means. The siphon tube is configured in accordance with the invention so as to reduce jetting in the shot cylinder. The molten aluminum alloy in the shot cylinder is then injected into a die to make the aluminum alloy casting.

BRIEF DESCRIPTION OF THE DRAWINGS

A full understanding of the invention can be gained from the following description of the preferred embodiment when read in conjunction with the accompanying drawings in which.

DETAILED DESCRIPTION OF THE PREFERRED EMBODIMENT

Figure 1:
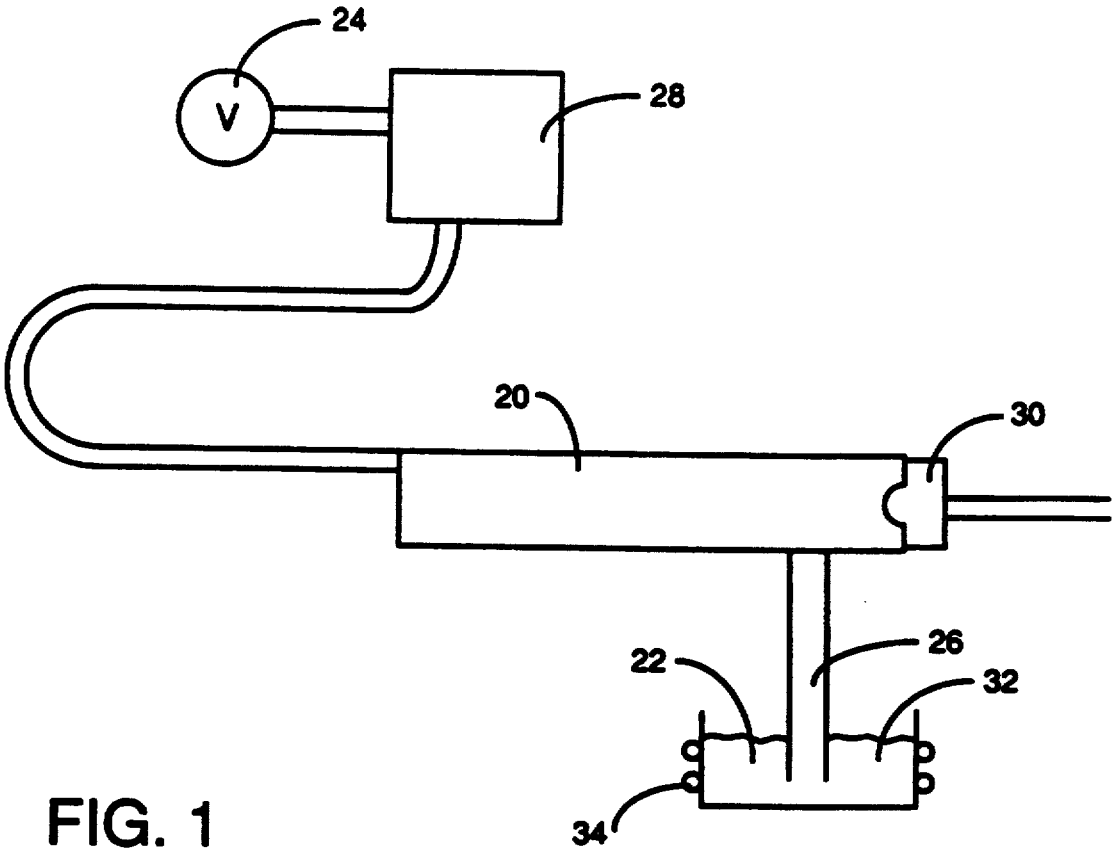
FIG. 1 is a schematic diagram of a vacuum die casting machine.

Referring to FIG. 1, a schematic diagram of a vacuum die casting system is shown. The system comprises a shot cylinder 20, a molten metal reservoir 22, a vacuum 24 and a siphon tube 26. The shot cylinder 20 is connected to a die 28 in the shape of an aluminum alloy casting to be made in the vacuum die casting process. The shot cylinder 20 has disposed therein a movable piston 30. Typical cast aluminum parts that can be made are automotive parts, such as frame parts (cast nodes, strut towers, front end and rear end joints) and body parts (body and door parts) or any casting requiring structural integrity.

The process of making a vacuum die casting includes providing a molten metal 32 in the reservoir 22. The molten metal 32 can come from a holding furnace, for example. The molten metal 32 is maintained at a casting temperature which depends on the alloy to be cast. This temperature is maintained by using a resistance heater 34, for example. Aluminum alloys which are suitable for this process include C119, A413, and A356.

The molten metal 32 is drawn through the siphon tube 26 when a vacuum is created by the vacuum means 24. The molten metal 32 travels through the siphon tube 26 into the shot cylinder 20. The amount of molten metal drawn into the shot cylinder 20 depends on the part being die cast. However, the total amount of molten metal drawn into the shot cylinder should take no longer than about 7 seconds and preferably between about 4–6 seconds to travel from the reservoir 22 into the shot cylinder 20. This will reduce freezing of the molten metal 32 in the siphon tube 26.

Once the proper amount of molten metal is deposited into the shot cylinder 20, the piston 30 is moved to inject the molten metal into the die 28. The piston stroke comprises initially a relatively slow movement to expel air from the shot cylinder 20 and then a rapid acceleration to inject the metal into the die 28.

Figure 2:
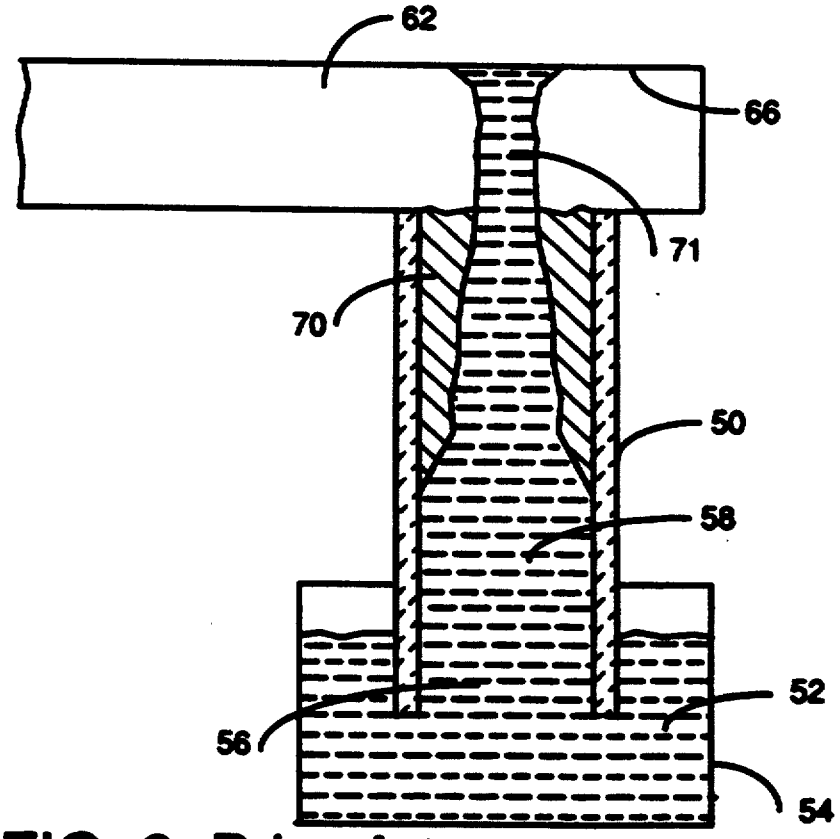
FIG. 2 Prior Art
FIG. 2 is a vertical section of a prior art siphon tube and shot cylinder showing necking of siphon tube and the jetting phenomenon.

Referring now to FIG. 2, a prior art siphon tube 50 is shown in vertical section. As can be seen, the siphon tube 50 transports molten metal 52 from the reservoir 54. The molten metal flows into the molten metal entry end 56 of the tube 50, travels through the passageway 58 defined by the siphon tube 50 and is introduced into the shot cylinder 62.

Repeated use of the siphon tube 50 leads to a frozen metal build-up along the inside walls thereof. This metal build-up is indicated at reference number 70. The metal build-up 70 is thicker at the shot cylinder end than at the molten metal entry end 56 because the metal cools as it rises through the siphon tube 50, thus causing freezing.

Thus, the passageway 58, which originally has a diameter of for example 20 mm as shown in FIG. 2, becomes "necked" and the diameter at the shot cylinder end is 10 mm, for example. This necking causes "jetting" of the molten metal into the shot cylinder 62, as is shown in FIG. 2. The molten metal jet 71 impinges on the inside wall surface 66 of the shot cylinder 62 causing erosion thereof. This causes shorter shot cylinder life as well as wear from frozen metal on top of the cylinder. Another problem with necking is that in order to avoid jetting, slower fill times are used which lead to problems with more freezing of the metal in the shot cylinder and longer shot cylinder filling times. Finally, necking creates control problems during shot cylinder filling because of the varying amount of molten metal introduced into the shot cylinder, which results in non-optimum filling behavior and thermal distortions in the shot cylinder.

Jetting also causes turbulence in the shot cylinder. That is, the molten metal in the shot cylinder will not be quiescent, and in fact may have "waves". This will result in the possibility of entrapping air into the molten metal during injection of the molten metal into the die. It is well known that entrapped air in the casting will cause porosity in the cast aluminum part.

Figure 3:
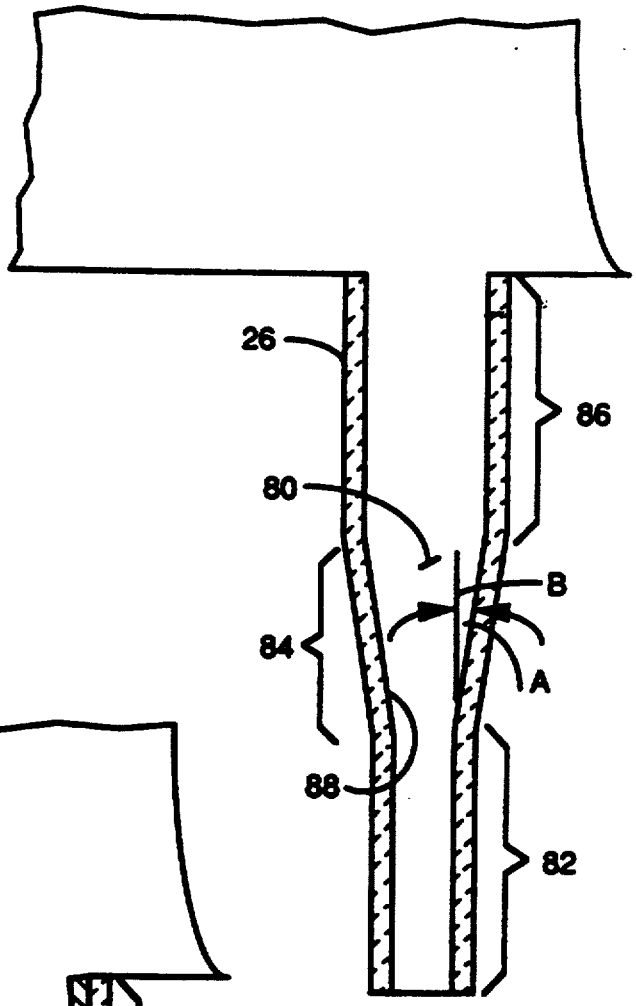
FIG. 3 is a vertical section of an improved siphon tube constructed in accordance with the invention.

FIG. 3 shows a vertical section of the siphon tube 26 of the invention. The siphon tube 26 is preferably made of a ceramic material, but can be ceramic lined steel with a graphite extension into the metal supply furnace. The siphon tube 26 defines a preferably cylindrical passageway 80 having a molten metal entry portion 82, a tapering portion 84 and a shot cylinder junction portion 86. The passageway 80 of the siphon tube 26 tapers from shot cylinder junction portion 86 to the molten metal entry portion 82. As can be seen, the tapering angle A, formed by the longitudinal axis B of the siphon tube and the inside wall 88 of the tapering portion 84 is preferably less than 20°. This will resist too abrupt of a step from the molten metal entry portion 82 to the shot cylinder junction portion 86.

The diameter of the siphon tube 26 preferably tapers from about 30 mm at the shot cylinder junction end to about 20 mm at the molten metal entry end. The shot cylinder junction portion 86 is preferably at least 1 inch long and more preferably about 2 inches long or longer and the tapering portion 84 is also preferably at least 1 inch long and more preferably about 2 inches long or longer (measured along the longitudinal axis B of the siphon tube).

Figure 4:
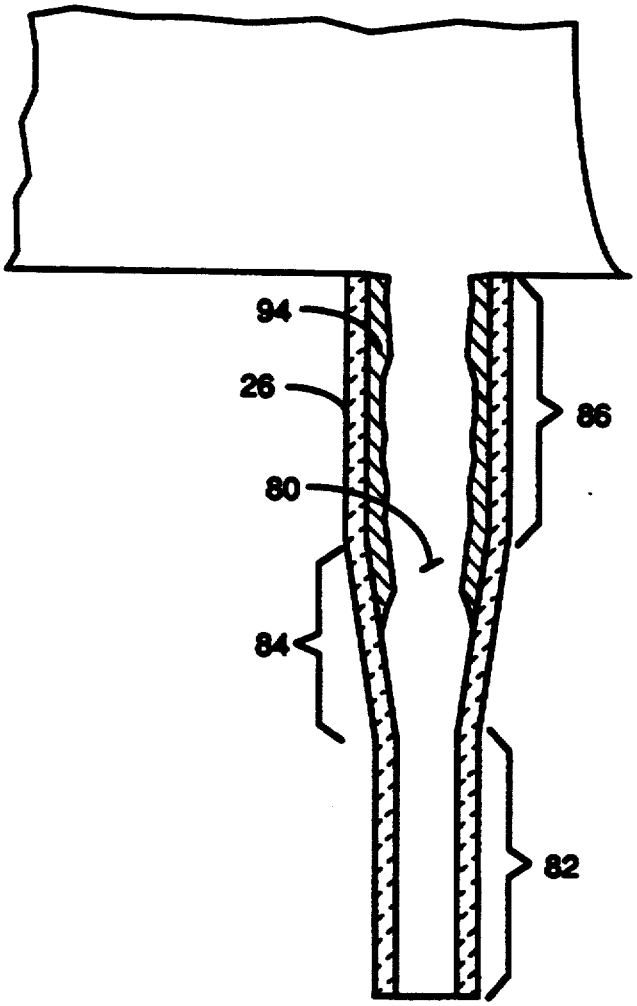
FIG. 4 is a vertical section of the improved siphon tube of the invention showing build-up of frozen metal on the inside surface thereof.

FIG. 4 shows the siphon tube 26 of the invention after it has been in use for a period of time. As can be seen, there is a build-up of frozen metal 94 on the inside surface of the passageway 80. This build-up is about 5–7 mm in the passageway 80. It has been found, quite surprisingly, that when the build-up reaches about 5–7 mm, that a "steady state" is reached and no more build-up occurs. Thus, the necked portion of the passageway 80 is about 20 mm or approximately equal to the passageway 80 diameter in the molten metal entry end. This will resist the jetting phenomenon discussed above with respect to FIG. 2.

It is believed that the "steady state" results from a balance between the "melt back" caused by contact with the new molten metal and the amount of metal that is frozen on the cold walls of the siphon tube. This, in turn, depends on the "super heat" of the particular alloy involved. The "super heat" is the temperature difference between the incoming metal temperature and its liquidus (the temperature at which the molten metal begins to freeze). The freezing can be affected by the filling time of the molten metal into the shot cylinder, wherein slower filling times result in more freezing of molten metal because of longer contact time with the cold walls of the siphon tube.

It will be appreciated that an improved siphon tube has been disclosed which resists jetting of molten metal in the shot cylinder of a vacuum die casting machine. The control of jetting leads to longer shot cylinder life, less freezing of metal in the shot cylinder and more quiescent conditions in the shot cylinder before injection into a die.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A vacuum die casting machine comprising:

shot cylinder means including a die;

vacuum means operatively associated with said shot cylinder means;

molten metal supply means; and a siphon tube communicating with said shot cylinder means to transport molten metal drawn from said molten metal supply means to said shot cylinder means by said vacuum means, said siphon tube defining a passageway having a first end portion adjacent said shot cylinder, a second end portion opposite said first end portion which defines a molten metal entry portion and an intermediate portion disposed between said first end portion and said second end portion;

said first end portion having a first passageway opening dimension and said second end portion having a second passageway opening dimension, said second passageway opening dimension being smaller than said first passageway opening dimension;

the passageway opening dimension of said intermediate portion being gradually reduced from said first passageway opening dimension to said second passageway opening dimension, whereby jetting of said molten metal from said siphon tube into said shot cylinder means and turbulence of said molten metal in said shot cylinder is resisted.

2. The machine of claim 1, wherein said siphon tube is made of a ceramic material.

3. The machine of claim 1, wherein said passageway is cylindrical in cross-section with said first end portion having a first diameter and said second end portion having a second diameter that is smaller than said first diameter; and said intermediate portion has a diameter that is gradually reduced from said first diameter to said second diameter.

4. The machine of claim 3, wherein, said first diameter is about 30 mm and said second diameter is about 20 mm.

5. A method of making an aluminum alloy casting comprising:

providing a supply of molten aluminum alloy;

drawing said molten aluminum alloy through a siphon tube from said molten aluminum alloy supply to a shot cylinder by vacuum means, said siphon tube defining a passageway having a first end portion adjacent said shot cylinder and a second end portion in proximity with said molten metal in said molten metal supply means;

solidifying an amount of said molten aluminum alloy in said passageway, said passageway being tapered from said first end portion to said second end portion in such a manner that jetting of said molten metal from said siphon tube into said shot cylinder and turbulence of said molten metal in said shot cylinder is resisted; and injecting said molten aluminum alloy in said shot cylinder into a die to make said aluminum alloy casting.

6. The method of claim 5, including employing as said molten aluminum alloy an alloy selected from the group consisting of C119, A413 and A356.

7. The method of claim 5, wherein said aluminum casting is an automotive part.

8. The method of claim 7, wherein said automotive part is a node for an automobile frame.

9. The method of claim 5, including drawing said molten metal into said shot cylinder in less than about 7 seconds.

10. The method of claim 9, including drawing said molten metal into said shot cylinder in about 4–6 seconds.

11. The method of claim 5, including drawing said molten metal through said passageway so that said molten metal does not impinge upon the inner surface of said shot cylinder opposite the portion of said shot cylinder adjacent said first end portion of said siphon tube.

* * * * *